US008904913B2

(12) United States Patent
Duneman

(10) Patent No.: US 8,904,913 B2
(45) Date of Patent: Dec. 9, 2014

(54) HAND OPERATED RIFLE CARTRIDGE LOADING PRESS AFFORDING A REPEATABLE DEGREE OF CRIMPING

(71) Applicant: Scott A. Duneman, Wayzata, MN (US)

(72) Inventor: Scott A. Duneman, Wayzata, MN (US)

( * ) Notice: Subject to any disclaimer, the term of this patent is extended or adjusted under 35 U.S.C. 154(b) by 146 days.

(21) Appl. No.: 13/835,029

(22) Filed: Mar. 15, 2013

(65) Prior Publication Data

US 2013/0263723 A1 Oct. 10, 2013

Related U.S. Application Data

(63) Continuation-in-part of application No. 12/930,676, filed on Jan. 13, 2011, now Pat. No. 8,438,962.

(60) Provisional application No. 61/294,750, filed on Jan. 13, 2010.

(51) Int. Cl.
*F42B 33/02* (2006.01)
*F42B 33/00* (2006.01)

(52) U.S. Cl.
CPC ..... *F42B 33/005* (2013.01); *F42B 33/004* (2013.01)
USPC ..... 86/23; 86/39

(58) Field of Classification Search
CPC .. F42B 33/005; F42B 33/001; F42B 33/0207; F42B 33/025; F42B 33/02
USPC ..... 86/23–33
See application file for complete search history.

(56) References Cited

U.S. PATENT DOCUMENTS

| | | | | | |
|---|---|---|---|---|---|
| 3,110,214 | A * | 11/1963 | Benda et al. | ..... | 86/36 |
| 3,240,104 | A * | 3/1966 | Bachhuber | ..... | 86/39 |
| 3,242,790 | A * | 3/1966 | Bachhuber | ..... | 86/29 |
| 3,347,128 | A * | 10/1967 | Bachhuber | ..... | 86/39 |
| 3,796,127 | A * | 3/1974 | Deitemeyer | ..... | 86/30 |
| 3,973,465 | A * | 8/1976 | Bachhuber et al. | ..... | 86/45 |
| 4,048,899 | A * | 9/1977 | Bachhuber et al. | ..... | 86/39 |
| 4,331,063 | A * | 5/1982 | Schaenzer | ..... | 86/36 |
| 4,336,739 | A * | 6/1982 | Alexander | ..... | 86/43 |
| 4,385,546 | A * | 5/1983 | Lee | ..... | 86/36 |
| 4,429,610 | A * | 2/1984 | Mantel | ..... | 86/36 |
| 4,515,063 | A * | 5/1985 | Lee | ..... | 86/27 |
| 4,522,102 | A * | 6/1985 | Pickens | ..... | 86/27 |
| 4,526,084 | A * | 7/1985 | David et al. | ..... | 86/38 |
| 4,852,451 | A * | 8/1989 | Rogers | ..... | 86/33 |
| 4,869,148 | A * | 9/1989 | Tucker | ..... | 86/43 |
| 5,763,810 | A * | 6/1998 | Lee | ..... | 86/45 |
| 6,041,687 | A * | 3/2000 | Fowler | ..... | 86/45 |
| 7,681,481 | B1 * | 3/2010 | Buckley | ..... | 86/26 |
| 7,703,369 | B1 * | 4/2010 | Lee | ..... | 86/43 |
| 7,854,188 | B1 * | 12/2010 | Buckley | ..... | 86/41 |

* cited by examiner

*Primary Examiner* — Samir Abdosh
(74) *Attorney, Agent, or Firm* — Brooks, Cameron & Huebsch, PLLC

(57) ABSTRACT

A hand operated press for reloading metal rifle cartridges including indicating means for providing for an operator of the press discrete indications of the different forces that can be manually applied through the drive mechanism during use of the press to crimp the second end of a cartridge against a bullet in the cartridge to allow the operator to use one of those indications to manually apply the same force to form essentially the same degree of crimp of the second ends of identical cartridges against identical bullets in the cartridges.

5 Claims, 8 Drawing Sheets

HAND OPERATED RIFLE CARTRIDGE LOADING PRESS AFFORDING A REPEATABLE DEGREE OF CRIMPING

This application claims the benefit of U.S. Provisional Application No. 61/294,750 filed Jan. 13, 2010, and is a continuation-in-part of U.S. application Ser. No. 12/930,676 filed Jan. 13, 2011, the entire content of which is incorporated herein by reference.

FIELD OF THE INVENTION

The present invention relates to a press used for reloading rifle cartridges, which press includes a manually operated drive mechanism for applying force between a second end of a cartridge being loaded and a forming surface in a die to crimp the second end of the cartridge against a bullet in the cartridge.

BACKGROUND

The art is replete with hand operated presses for reloading elongate metal rifle cartridges of the type each having a first end adapted to receive a primer, an opposite second end, and a hollow cylindrical end portion adjacent its second end. Such a press typically comprises a cartridge receptacle adapted to releasably receive and support the first end of such a cartridges of a predetermined shape and size (e.g., a 30-06, 0.308, 0.223, or 0.270 cartridge); and a die having an inner surface defining a cavity adapted to receive at least the second end portion of the cartridge of that predetermined shape and size with a portion of a bullet closely received within that second end portion and a portion of that bullet projecting from the second end of the cartridge. That inner surface of the die includes a forming surface shaped to crimp the second end of the cartridge into engagement with the surface of the bullet to retain the bullet in the cartridge when the cartridge is pressed longitudinally into the die by the press. The press includes a die support member that engages and supports the die, and a cartridge receptacle support member that supports the cartridge receptacle; and means mounting the cartridge receptacle support member and die support member for relative movement between (1) a first relative position with the cartridge receptacle sufficiently spaced from the die to afford manually positioning the cartridge on or removal of the cartridge from the cartridge receptacle, and (2) a second relative position with the second end portion of the cartridge supported on the cartridge receptacle within the die with the second end of the cartridge pressed against the forming surface. A manually operable drive mechanism is provided for moving the cartridge receptacle support and die support members between those first and second relative positions, with which drive mechanism an operator can manually apply different forces between the second end of a cartridge on the cartridge receptacle and the forming surface to crimp the second end of the cartridge into engagement with the bullet in the cartridge. Typically that manually operable drive mechanism comprises a first elongate bar having a first end pivotably attached to the cartridge receptacle support member, a second elongate bar having a first end pivotably attached to the die support member, with a second end of the second elongate bar opposite its first end being pivotably attached to the first elongate bar at or adjacent its second end, and a ridged elongate handle having a drive end portion fixed to the first elongate bar at its second end, and an opposite manually engage able end portion. Torque can be manually applied through the handle to the first elongate bar from the manually engage able end portion to drive the cartridge receptacle support and die support members from their first to their second relative positions so that the die crimps the second end of a cartridge on the cartridge receptacle against a bullet in that cartridge.

Finding a load for a rifle cartridge for use in a specific rifle that provides desired characteristics (e.g., bullet structure and weight, muzzle velocity) and the greatest precision when fired from that specific rifle is a tedious and time consuming process. That process typically requires testing many possible combinations of suitable primers, bullets, powder types and weights of those powder that can be used, by loading several (e.g., five) rifle cartridges with each combination using a hand operated press of the type described above. Publications such as "Speer Reloading Manual, Rifle and Pistol" published by Speer, Lewiston, Ind. are consulted to determine the combinations of primers, bullets and power weight ranges of various powders that can be used and the muzzle velocities that those combinations should produce. Extreme care is taken to be sure that the rifle cartridges loaded with each selected combination are clean and that their cylindrically tubular second end portions in which the bullets are retained (which may be resized by the press) are of the same size. Also, the weight of powder placed in each cartridge is very carefully measured for consistency between the cartridges. The loader is also instructed by the literature to form a "good crimp" between the second end of the cartridge and the bullet. The loaded cartridges of each combination are fired at the same target from that specific rifle with the rifle carefully aimed at the same spot on the target while the rifle is cradled and retained in a rile rest supported on a firm horizontal surface so that only the rifles trigger is contacted as it is fired. The maximum distance between the group of holes in the target formed by the bullets is then measured. The combination forming the smallest group is considered to provide the greatest precision.

DISCLOSURE OF THE INVENTION

Surprisingly, applicant has discovered that the degree of crimping of second ends of cartridges against the surfaces of bullets within the second end portions of the cartridges can significantly affect the precision produced by firing of those loaded cartridges from the same rifle when there is no difference between those loaded cartridges other than that degree of crimping (i.e., the cartridges are identical; and the loaded cartridges include identical primers, bullets, and the same type and weight of powder).

FIG. 3 of the drawing illustrates a series of five targets into each of which five shots have been fired from the same rifle from five loaded cartridges that only differed from the five loaded cartridges fired through each of the other targets by the degree of crimping of the second ends of those cartridges against the bullets in them (the degree of crimping being different for each set of five loaded cartridges). As can be seen, the precision of the shots varied significantly, with the precision of the shots through the forth target from the left being the best. Thus for use in that same rifle it could be desirable to load identical cartridges using the same degree of crimping that was used to load the five cartridges fired through the forth target from the left. This can be accomplished using the present invention that comprises a hand operated press generally of the type described above for reloading metal rifle cartridges that includes indicating means for providing for an operator of the press discrete indications of a plurality of the many forces that can be manually applied through the drive mechanism during use of the press to crimp the second end of a cartridge against a bullet in the cartridge to allow the operator to manually apply the same force to form essentially the same degree of crimp of the second ends of identical cartridges against identical bullets in the cartridges.

In some embodiments of the present invention that indicating means comprises a torque wrench having a drive end portion fixed to the first elongate bar of the drive mechanism for the press at its second end, an opposite manually engage able end portion opposite the drive end, and torque indicating means between the drive end and manually engage able end portions for indicating when a predetermined torque has been applied through the torque wrench to the first elongate bar from the manually engageable end portion to drive the cartridge receptacle support and die support members from their first relative position to their second relative position. While many types of known torque wrench assemblies could be adapted for such use, the torque wrench sold by Shaoxing County Dom Machinery Co. Ltd., RM D, 3/F Foreign Trade Building, Keqiao, Shaoxing, Zhejian under the trade designation Model TG100 that has been modified to measure a torque range of from 5 to 75 foot-pounds in 1 foot-pound increments has been found desirable because its torque range and small torque measuring increments, and because its physical shape is similar to that of the rigid handle that it replaces for use in crimping the second ends of cartridges against bullets in the cartridges. The drive end portion and the manually engage able end portion of that torque wrench are both straight and elongate, both having a longitudinally extending central axis. Adjacent end parts of the manually engage able portion and the drive end portions are pivotally mounted on each other for relative movement of those portions around a transverse axis between a normal position with the central axes of the manually engage able end portion and the drive end portion aligned, and an easily detectable indicating position with the central axes of the manually engage able end portion and the drive end portion disposed at a small angle relative to each other. The torque wrench includes manually adjustable means between its manually engage able end portion and its drive end portion for selecting the amount of torque required to move its manually engage able end portion and its drive end portion to its indicating position from its normal position thereby providing the indicating means.

In other embodiments of the present invention that indicating means on the press comprises a load cell mounted on the cartridge receptacle support member or on the die support member in a position to be deformed by a force applied by the drive mechanism to press the second end of the cartridge against the forming surface of the die, and means connected to the load cell for providing a visual numerical indication of the amount of load received by the load cell because of that applied force. In one such embodiment the load cell is mounted between the die and the die support member, and in another the load cell is mounted between the cartridge receptacle support member and the cartridge receptacle.

It would seem difficult to accurately determine the exact amount of pressure being applied by the forming surface of the die against the end portion of the cartridge to crimp it against the bullet from either the torque setting on the torque wrench when it moves to its indicating position or from one of the numerical indications produced by the load cell assemblies during such crimping. That torque setting or that numerical indication does, however, allow an operator of the press to manually apply forces through the drive mechanism that will, presumably with the same amount of pressure from the forming surface of the die, repeatably crimp the second ends of identical cartridges (i.e., cartridges of the same size, shape, and material) against identical bullets (i.e., bullets of the same size, shape, material or materials, and structure) to provide the same degree of crimp in the loaded cartridges. Thus after a person reloading cartridges has done testing to determine a degree of crimp indicted by such a torque setting or by such a numerical indication that provides the most precision when several identical cartridges loaded with identical primers, bullets, the same powder and weigh of powder and so crimped are fired from a specific rifle, that degree of crimping may be accurately reproduced during future loadings of identical cartridges with identical primers, bullets and the same powder and weight of powder. By degree of crimp we mean to include, but not be limited to, the shape and contact area against the bullet of the second end of the cartridge and the pressure with which that second end engages the periphery of the bullet. It is possible that such identical loaded cartridges that produce good precision in a specific rifle will not produce the same precision in another rifle of the same caliber because of different physical characteristics between the rifles.

BRIEF DESCRIPTION OF DRAWING

The present invention will be further described with reference to the accompanying drawing wherein like reference numerals refer to like parts in the several views, and wherein.

DETAILED DESCRIPTION

FIGS. 1, 4, 5, 6 and 7 illustrate a first embodiment of a hand operated press 10 according to the present invention, and an adapting kit used to make that press 10 by modifying a press for reloading rifle cartridges that is commercially available under the trade designation "Lee Classic Turret Press" (called Lee Press herein) from Lee Precision, Inc., Hartford Wis. (Information about that press in addition to that provided herein is provided in the owner's manual for that Lee Press or over the internet from Lee Precision, Inc., the content whereof is hereby incorporated herein by reference).

Figure 1:
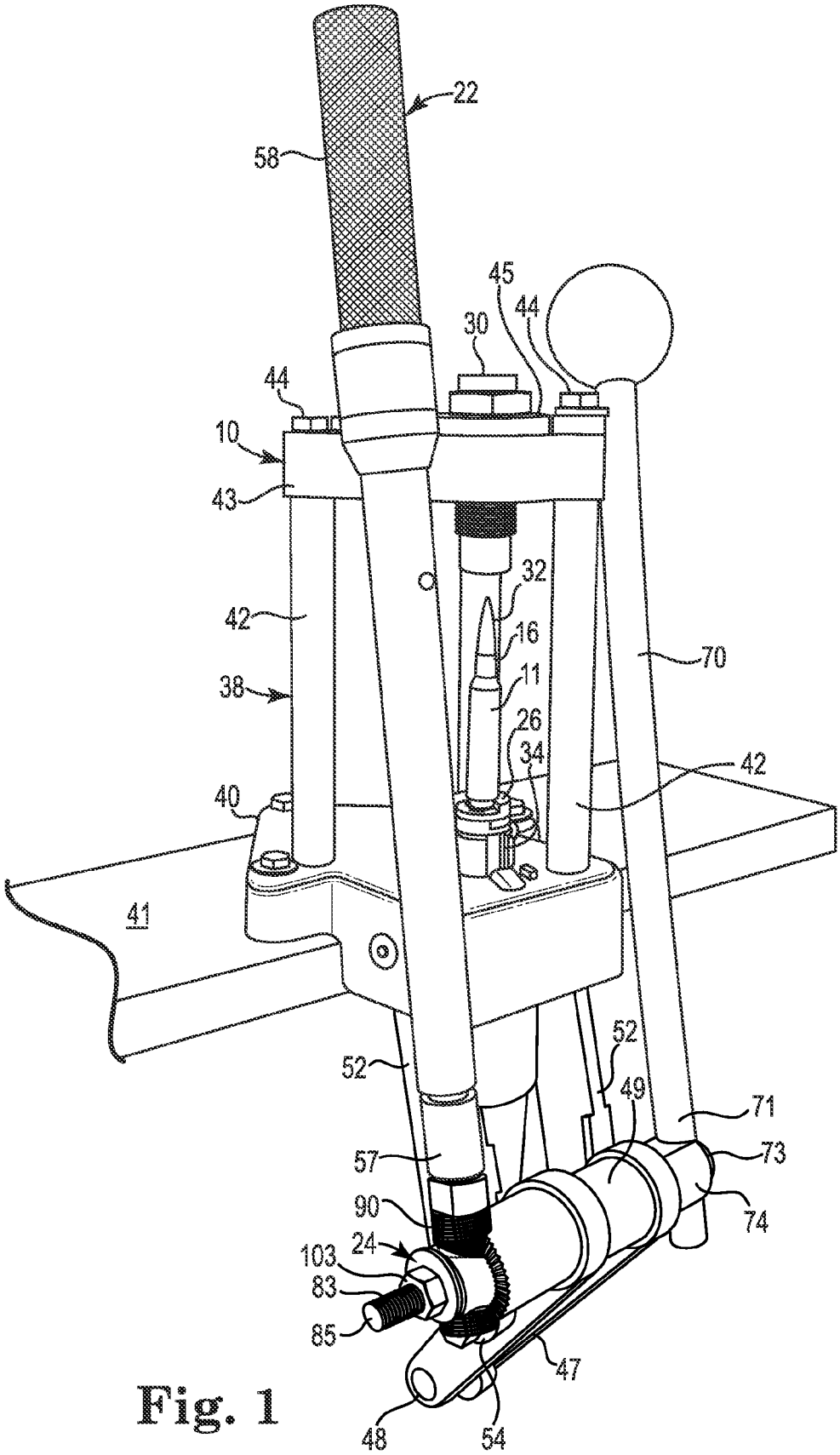
FIG. 1 is a view in perspective of a first embodiment of a hand operated press for reloading rifle cartridges according to the present invention, which press includes indicating means comprising a torque wrench.
Figure 3:
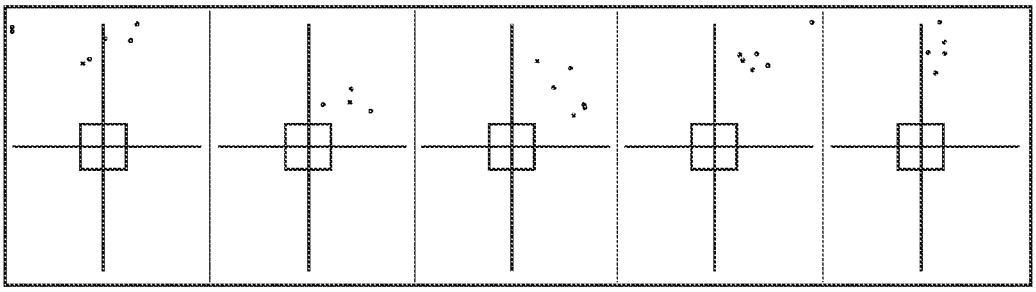
FIG. 3 is a plan view of five target sheets through which groups of five bullets having the characteristics described above have been fired from the same rifle.
Figure 2:
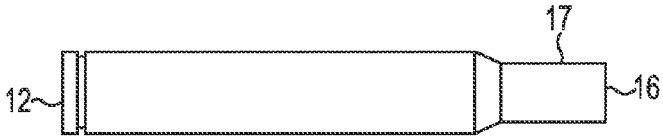
FIG. 2 is a side view of a typical rifle cartridge that could be reloaded using the presses illustrated in FIGS. 1, 8, 9, and 10.
Figure 5:
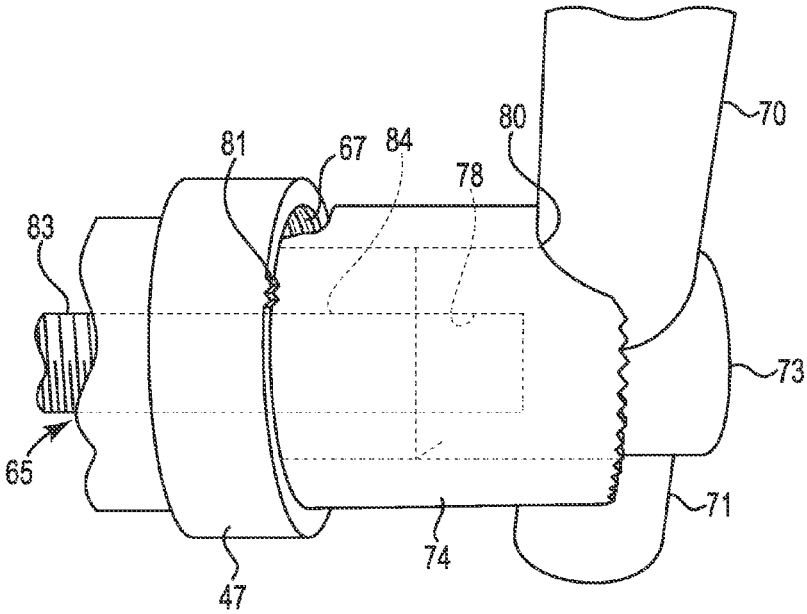
FIG. 5 is a fragmentary perspective view of part of a drive mechanism for the press illustrated in FIG. 1 having parts broken away to show details
Figure 4:
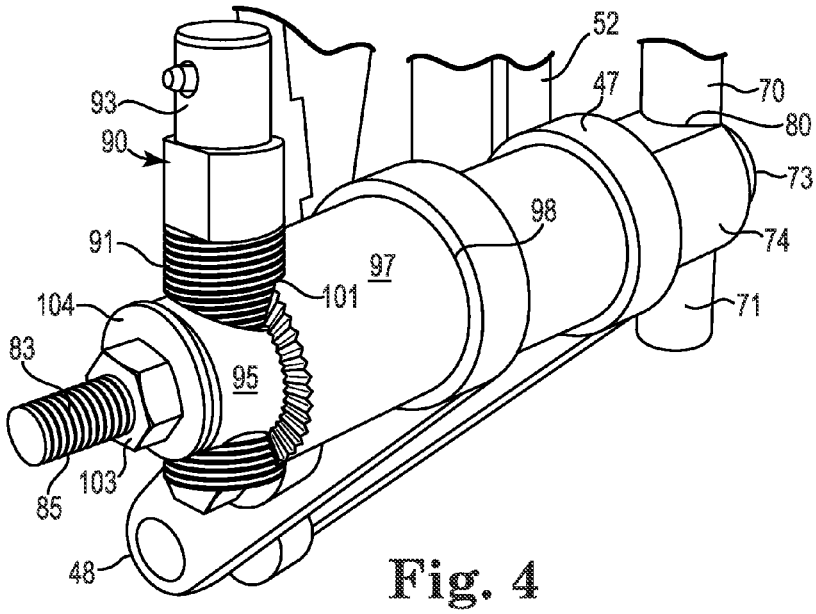
FIG. 4 is a fragmentary perspective view of part of a drive mechanism for the press illustrated in FIG. 1.
Figure 7:
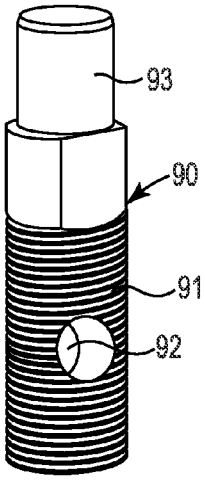
FIG. 7 is a perspective view of an adapter included in the drive mechanisms for the presses illustrated in FIGS. 1 and 8.
Figure 6:
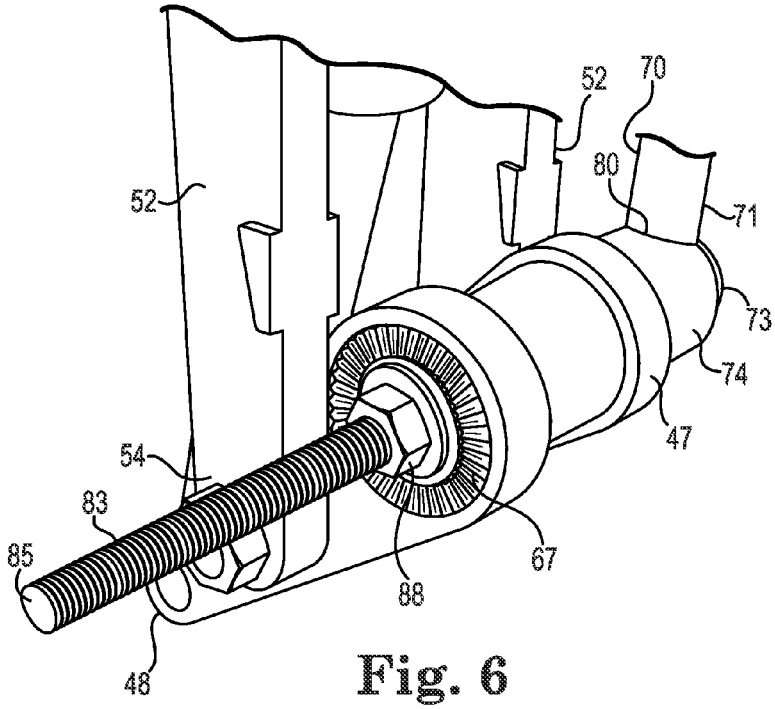
FIG. 6 is a fragmentary perspective view of part of a drive mechanism for the press illustrated in FIG. 1 having parts removed to show details.

The press 10 is adapted for reloading elongate metal rifle cartridges 11 of the type illustrated in FIG. 2 that each have a first end 12 with a through passageway adapted to receive and frictionally retain a primer, an opposite second end 16, and a generally cylindrical second end portion 17 ending at that second end 16. The modification of the Lee Press to make the press 10 includes the addition of indicating means comprising a torque wrench 22 attached to a drive mechanism of the press 10 by an adapter kit that will later be described.

Generally, the press 10 includes a cartridge receptacle 26 (a part of the Lee Press) adapted to releasably receive and support the first end 12 of a cartridge of a predetermined size and shape by sliding the cartridge transversely of its longitudinal axis into the receptacle 26 so that a generally U shaped lip in the receptacle 26 engages in a groove around the cartridge 11 spaced a short distance from its first end 12. Also, the press 10 includes a die 30 (e.g., the die that is commercially available under the trade designation "Lee Factory Crimp Die" from Lee Precision, Inc., Hartford, Wis.). The die 30 has an inner surface (not shown) defining a cavity adapted to receive the second end portion 17 of the cartridge 11 with a portion of a bullet 32 closely received within its second end portion 17 and a portion of that bullet 32 projecting from the second end 16 of the cartridge 11. The inner surface of the die 30 includes a forming surface shaped to crimp the second end 17 of the cartridge 11 into engagement with the periphery of the bullet 32 to retain the bullet 32 in the cartridge 11 when the cartridge 11 is pressed longitudinally into the die 30. The press 10 also includes an elongate cylindrical support member 34 for the cartridge receptacle 26 (a part of the Lee Press) that releasably supports the cartridge receptacle 26 at its normally upper first end; together with a die support member or assembly 38 (also a part of the Lee Press) that supports the die 30, and means mounting the cartridge receptacle support and die support members 34 and 38 for relative movement between a first relative position illustrated in FIG. 1 with the cartridge receptacle 26 sufficiently spaced from the die 30 to afford manually portioning the cartridge 11 on or removal of the cartridge 11 from the cartridge receptacle 26, and a second relative position (not shown) with the second end portion 17 of the cartridge 11 supported on the cartridge receptacle 26 within the die 30 with the second end 16 of the cartridge pressed against the forming surface in the die 30. That die support member 38 (a part of the Lee Press) includes a cast metal base plate 40 adapted to have its bottom surface supported on a wooden support 41 to which it is bolted, three spaced rods 42 projecting from an upper surface of the base plate 40, an upper plate 43 at the ends of the rods 42 opposite the base plate 40, which upper plate 43 and rods 42 are attached to the base plate 40 by bolts 44 passing through the upper plate 43 and rods 42, and a die retaining plate or turret 45 releasably engage able with the upper plate 43 with which die retaining plate 45 the die 30 is threadably engaged. The means mounting the cartridge receptacle support and die support members 34 and 38 for relative movement between their first and second relative positions described above includes a surface defining a bore through the base plate 40 of the die support member 38 in which bore the elongate cylindrical cartridge support member 34 is closely received for longitudinal sliding movement with its upper first end that releasably supports the cartridge receptacle 26 adjacent the upper plate 43 and axially aligned with the die 30 on the die retaining plate 45.

The press 10 also includes a manually operable drive mechanism for moving the cartridge receptacle support and die support members 34 and 38 between their first and second relative positions and for manually applying different amounts of force between the second end 16 of a cartridge 11 on the cartridge receptacle 26 and the forming surface in the die 30 to crimp the second end 16 of the cartridge into engagement with the periphery of the bullet 32 in the cartridge 11. That manually operable drive mechanism comprises a first elongate bar or bar assembly 47 having a first end 48 pivotably attached to a second end of the cartridge support member opposite its upper first end; and two elongate second bars 52 having first ends pivotably attached in spaced relationship to the base plate 40 of the die support member 38, and second ends 54 pivotably attached to the first bar 47 adjacent its second end opposite its first end 48. The manually operable drive mechanism for the press 10 further includes the elongate torque wrench 22 which has a drive end portion 57 fixed to the first elongate bar 47 at its second end 49 by the adaptor kit, an opposite manually engage able end portion 58 opposite the drive end projection 57, and torque indicating means between the drive end and manually engage able end portions 57 and 58 for indicating when a predetermined torque has been applied from the drive end portion 58 through the torque wrench 22 to the second end 49 of the first elongate bar 47 to drive the cartridge receptacle support and die support members 34 and 38 from their first to their second relative positions, thereby providing the indicating means for providing for an operator of the press discrete indications of different forces that can be manually applied through the drive mechanism during use of the press to crimp the second end 16 of a cartridge 11 against a bullet 32 in the cartridge 11 to allow the operator to manually apply the same force to form essentially the same degree of crimp of the second ends 16 of identical cartridges 11 against identical bullets 32 in the cartridges 11.

While many types of known torque wrench assemblies could be adapted for such use, the torque wrench sold by Shaoxing County Dom Machinery Co. Ltd. noted above that has been modified by that company to measure a torque range of from 5 to 75 foot pounds and to have adjustment increments of 1 foot pound has been found desirable because of its torque range and adjustment increments, and because of its physical shape that is similar to that of the rigid drive lever or handle typically provided on such presses.

The drive end portion 57 and the manually engage able end portion 58 of that torque wrench 22 are both straight and elongate, and both include a longitudinally extending central axis. Adjacent end parts of the manually engage able end portion 58 and the drive end portion 57 are pivotally mounted on each other by a transverse pin 59 for relative movement of those portions 57 and 58 about a transverse axis between a normal position with the longitudinal axes of the manually engage able end portion 58 and the drive end portion 57 aligned, and an indicating position with the longitudinal axes of the manually engage able end portion 58 and the drive end portion 57 disposed at a small angle relative to each other, and the torque wrench includes manually adjustable means between its manually engage able end portion 58 and its drive end portion 57 for selecting the amount of torque required to move its manually engage able end portion 58 from the normal position to the indicating position relative to the drive end portion 57 thereby providing the indicating means on the press 10.

The first end of the bar or bar assembly 47 has surfaces defining a through passageway 65 with an axis parallel to the pivot axes of the bar assembly 47, and has arrays of teeth 67 around the passageway 65 on opposite sides of the bar assembly 47. The drive mechanism for the press 10 includes a manually engageable drive lever 70 that has an end portion 71 fixed to one side of the bar assembly 47 by a first clamp member 73 and a first sleeve 74. The first clamp member 73 is generally cylindrical about an axis, has a through opening transverse to its axis in which the end portion 71 of the lever 70 is positioned and an axially extending internally threaded socket 78 opening through one end. The first sleeve 74 has a through axially extending opening slideably receiving the first clamp member 73, a transverse recess 80 from one end receiving one side of the end portion 71 of the lever 70, and projecting teeth 81 around the end of the first sleeve 74 opposite the transverse recesses 80. The teeth 81 on the first sleeve 74 engage the teeth 67 around the passageway 65 on one side of the first bar assembly 47, the first clamp member 73 is adapted to pull the end portion 71 of the lever 70 extending through the transverse opening 76 in the first clamp member 73 into the transverse recesses 80 in the first sleeve 74 and thereby the teeth 81 on the first sleeve 74 against the teeth 67 on one side of the bar assembly 47 when the end portion of the first clamp having the internally threaded socket 78 is firmly pulled toward the bar assembly 47 to thereby retain the end portion 71 of the lever 70 in the transverse through opening 76 in the first clamp member 73 and in the transverse recess 80 of the first sleeve member 74 and, by engagement of the teeth 81 on the first sleeve 74 with teeth on 67 the bar assembly 47, restrict rotation of the lever 70 relative to the bar assembly 47.

A threaded shaft 83 has a first end portion 84 extending through the passageway 65 in the bar assembly 47 and the first sleeve 74 and threadably engages the internally threaded socket 78 in the first clamp member 73. The threaded shaft 83 also has a second end portion 85 projecting from the side of the bar assembly 47 opposite the first clamp member 73 and first sleeve 74. A first nut 88 threadably engages the second end portion 85 of the threaded shaft 83 and engages the side of the bar assembly 47 opposite the first clamp member 73 to pull the first clamp member 73 toward the bar assembly 47 and the end portion of the lever 70 extending through the transverse opening in the first clamp member 73 into the transverse recesses 80 in the first sleeve member 74 to pull the teeth 81 on the first sleeve member 74 against the teeth 67 on the side of the bar assembly 47 opposite the first nut 88.

An adapter 90 (see FIGS. 4 and 7) has a cylindrical threaded first end portion 91 having a transverse through opening 92 receiving the second end portion 85 of the threaded shaft and affording transverse sliding movement of the first end portion 91 along the threaded shaft 83. The threads on the first end portion 91 are not required for its use on the press 10, but made it useful for use on a press 110 later described herein, The adapter 90 also has a second end portion 93 opposite its first end portion 91 shaped to releasably engage in a socket opening through the distal end of the drive end portion 57 of the torque wrench 22. A second clamp member 95 that is generally cylindrical about an axis, has a through opening transverse to its axis that receives the first end portion 91 of the adapter 90, and has an axially extending through opening adapted to receive the second end portion 85 of the threaded shaft 83 and afford sliding movement of the second clamp member 95 along the threaded shaft 83. A second sleeve 97 has an axially extending through opening between first and second ends. That opening in the second sleeve 97 receives the first nut 88, the second end portion 85 of the threaded shaft 88 that extends through it, and the second clamp member 95. The second sleeve 97 has projecting teeth around its first end 98 that engage the teeth 67 around the passageway 65 on the side of the bar assembly 47 opposite the first sleeve 74; and has a transverse recess 101 from its second end that receives one side of the first end portion 91 of the adapter 90. A second nut 103 threadably engages the second end portion 85 of the threaded shaft 83 and through a washer 104 that second nut 103 applies pressure against the end of the second clamp member 95 opposite the bar assembly 47 to secure the first end portion 91 of the adapter 90 in the transverse opening 96 of the second clamp member 95 against the transverse recesses 101 in the second sleeve 97 and the teeth on the second sleeve 97 against the teeth 67 on the side of the bar assembly 47 opposite the first sleeve 74.

The threaded shaft 83, the first and second nuts 88 and 103, the washer 104, the adaptor 90, the second clamp member 95 and the second sleeve 97 are parts of the kit used to modify the Lee Press. that affords engagement of the torque wrench with the manually operated drive mechanism while still allowing the lever 70 to be used to operate the drive mechanism when that may be more desirable, such as to press a cartridge into a die (such as a shaping die, also known as a full length shaping die) other than the die 30 for crimping the second end of the cartridge against a bullet in the cartridge 11.

Figure 8:
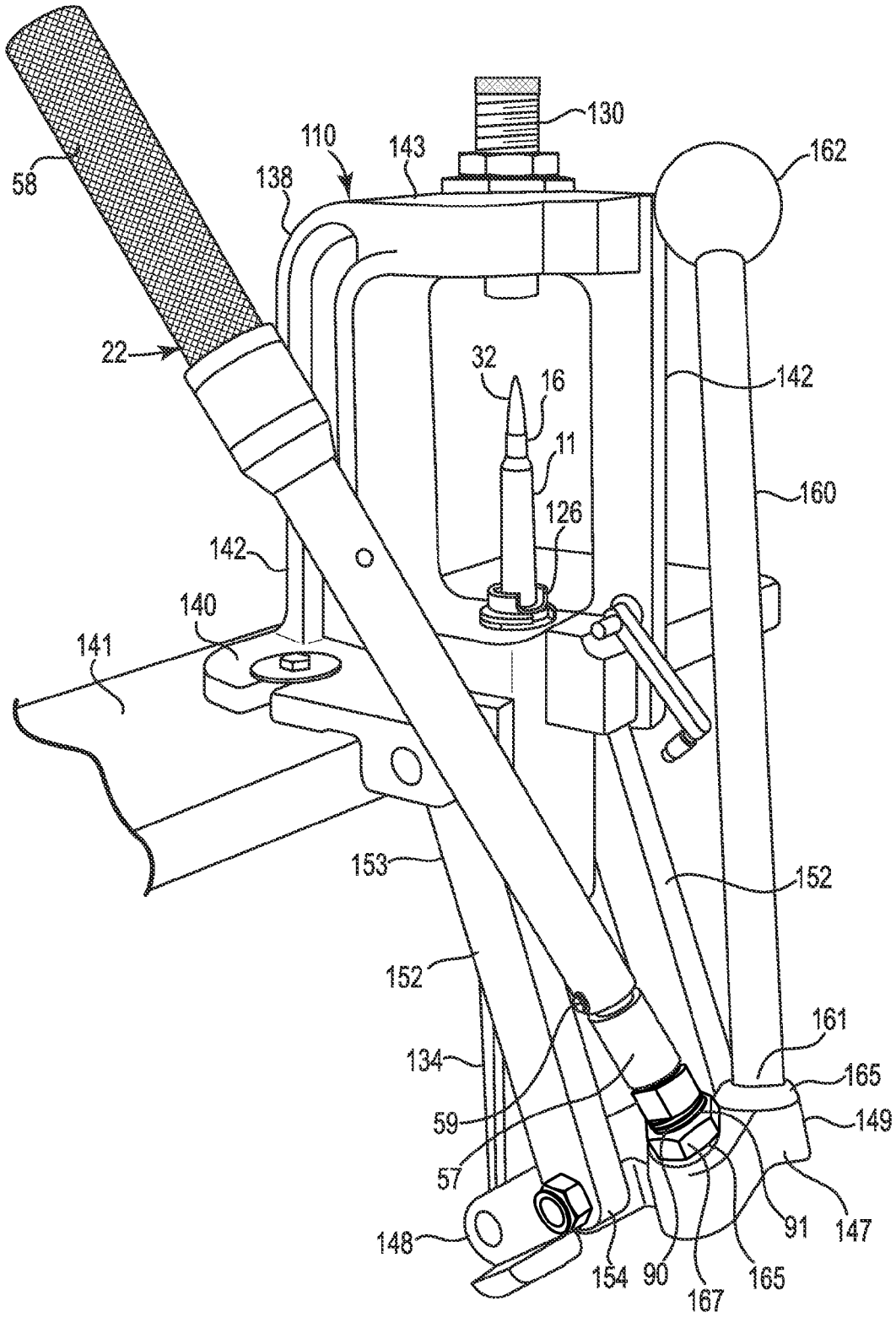
FIG. 8 is a view in perspective of a second embodiment of a hand operated press for reloading rifle cartridges according to the present invention, which press includes indicating means comprising a torque wrench.

FIG. 8 illustrates a second embodiment of a hand operated press 110 according to the present invention, which press 110 is a modification of a press for reloading rifle cartridges that is commercially available under the trade designation "Rock Chucker Supreme Press" from RCBS, Oroville, Calif. (Information about that press in addition to that provided herein is provided in the "Rock Chucker Supreme Press Parts List" available from RCBS, the content whereof is hereby incorporated herein by reference).

The press 110 is adapted for reloading elongate metal rifle cartridges 11 of the type illustrated in FIG. 2. The modification to the commercially available press identified above to make the press 110 includes only the addition of an indicating means for providing for an operator of the press 110 discrete indications relating to different forces that can be manually applied through the drive mechanism during use of the press 110 to crimp the second end 16 of a cartridge 11 against a bullet 32 in the cartridge 11 to allow the operator to use one of those indications to manually apply the same force to form essentially the same degree of crimp of the second ends 16 of identical cartridges 11 against identical bullets 32 in the cartridges 11. That added indicating means includes the torque wrench 22 described above with reference to the press 10 illustrated in FIG. 1, and the adapter 90 that is used for attaching the torque wrench 22 to the drive mechanism of the press 110.

Generally, the press 110 includes a cartridge receptacle 126 adapted to releasably receive and support the first end 12 of a cartridge 11 of a predetermined size and shape. Also, the press 110 includes a die 130 (e.g., the "Lee Factory Crimp Die" from Lee Precision, Inc., Hartford Wis. that is noted above). The die 130 has an inner surface (not shown) defining a cavity adapted to receive the second end portion 17 of the cartridge 11 with a portion of a bullet 32 of a predetermined size and shape closely received within its second end portion 17 and a portion of the bullet 32 projecting from the second end 16 of the cartridge 11. The inner surface of the die 30 includes a forming surface shaped to crimp the second end 17 of the cartridge 11 into firm engagement with the periphery of the bullet 32 to retain the bullet 32 in the cartridge 11 when the cartridge 11 is pressed longitudinally into the die 130. The press 11 also includes an elongate cylindrical support member 134 for the cartridge receptacle 126 that releasably supports the cartridge receptacle 126 at its normally upper first end; together with a die support member 138 that supports the die 130, and means mounting the cartridge receptacle support and die support members 134 and 138 for relative movement between a first relative position illustrated in FIG. 9 with the cartridge receptacle 126 sufficiently spaced from the die 130 to afford manually portioning the cartridge 11 on or removal of the cartridge 11 from the cartridge receptacle 126, and a second relative position (not shown) with the second end portion 17 of the cartridge 11 supported on the cartridge receptacle 26 within the die 130 with the second end 16 of the cartridge pressed against the forming surface in the die 130. That die support member 138 is a generally "D" shaped casting that includes a base portion 140 adapted to have its bottom surface supported on a wooden support 141 to which it is bolted, opposite spaced portions 142 projecting from an upper surface of the base plate 140, and an upper portion 143 at the ends of the spaced portions 142 opposite the base portion 140, which upper portion 143 has a through internally threaded passageway in which the die 130 is threadably engaged. The means mounting the cartridge receptacle support and die support members 134 and 138 for relative movement between their first and second relative positions described above includes a surface defining a bore through the base portion 140 of the die support member 138 in which bore the elongate cylindrical cartridge receptacle support member 134 is closely received for longitudinal sliding movement with its upper first end that releasably supports the cartridge receptacle 126 adjacent the upper portion 143 and axially aligned with the die 130 on the upper portion 143.

The drive mechanism mentioned above can be manually operated to move the cartridge receptacle support and die support members 134 and 138 between their first and second relative positions and to applying different forces between the second end 16 of a cartridge 11 on the cartridge receptacle 126 and the forming surface in the die 130 to crimp the second end 16 of the cartridge 11 into engagement with the periphery of the bullet 32 in the cartridge 11. That manually operable drive mechanism comprises a first elongate bar 147 having a first end 148 pivotably attached to a second end of the cartridge receptacle support member opposite its upper first end; and two elongate second bars 152 having first ends 153 pivotably attached in spaced relationship to the base portion 140 of the die support member 138, and second ends 154 pivotably attached to the first elongate bar 147 adjacent its second end 149 opposite its first end 153.

As illustrated, the manually activateable drive mechanism of the press 110 can further include a stiff drive lever 160 having one end portion 161 threadably engaged in one of two internally threaded sockets 165 at the second end 149 of the first elongate bar 147, which sockets 165 are provided on the press in positions so that the drive lever 160 could be engaged with either one of the sockets 165 to position the bar 106 in positions convenient either for left hand use or for right hand use (as illustrated). The lever 160 is thereby fixed to the first elongate bar 147 at its second end 149, and has an opposite manually engage able end portion 162 terminating in a ball that can be manually used to rotate the lever 160 and thereby the first elongate bar 147 to which it is fixed to move the cartridge receptacle support member 134 toward the die 130 and the cartridge receptacle support and die support members 134 and 138 members from their first to their second relative positions. Such use of that lever 160 may be preferred when he press 110 is being used with a type of die other the type of die 130 used to crimp the end portions 16 of cartridges 11 around bullets in the end portions 17 of the cartridges 11, such as when the press 110 is used with a die (not shown), such as a full length sizing die, for resizing a part or all of a cartridge 11.

As noted above, the manually activate able drive mechanism of the press 110 includes the elongate torque wrench 22. The torque wrench 22 has its drive end portion 57 fixed to the first elongate bar 147 at its second end 149 by the adapter 90, its opposite manually engage able end portion 58 projecting to a position adapted for manual engagement, and torque indicating means between the drive end and manually engage able end portions 57 and 58 for indicating when a predetermined torque has been applied from the drive end portion 57 through the torque wrench 22 to the second end 154 of the first elongate bar 147 to drive the first elongate bar 147 and thereby move the cartridge receptacle support member 134 toward the die 130 to move the cartridge receptacle support and die support members 134 and 138 members from their first to their second relative positions and the second end portion 16 of a cartridge 11 on the cartridge receptacle 26 into engagement with the forming surface in the die 130 to crimp the second end 16 of the cartridge 11 into engagement with the periphery of the bullet 32 in the cartridge 11, thereby providing the indicating means for the press 110.

The threaded first end portion 91 of the adapter 90 for attaching the torque wrench 22 to the drive mechanism of the press 110 is adapted to threadably engage in one of the two internally threaded sockets 165 at the second end 149 of the first elongate bar 147. The second end portion 93 is shaped to releasably engage in a socket opening through the distal end of the drive end portion 57 of the torque wrench 22. A nut 167 around the threaded first end portion 91 that can be tightened against the second end 149 of the bar 147 after that end portion 91 is threadably engaged with it to provide a position for the torque wrench 22 at which the transverse pivot axis provided by the pin 59 is generally parallel with the pivot axes at the ends of the bars 147 and 152, and torque indicating movement of the manually engage able end portion 58 from its normal position to its indicating position relative to the drive end portion 57 is toward the operator.

Figure 9:
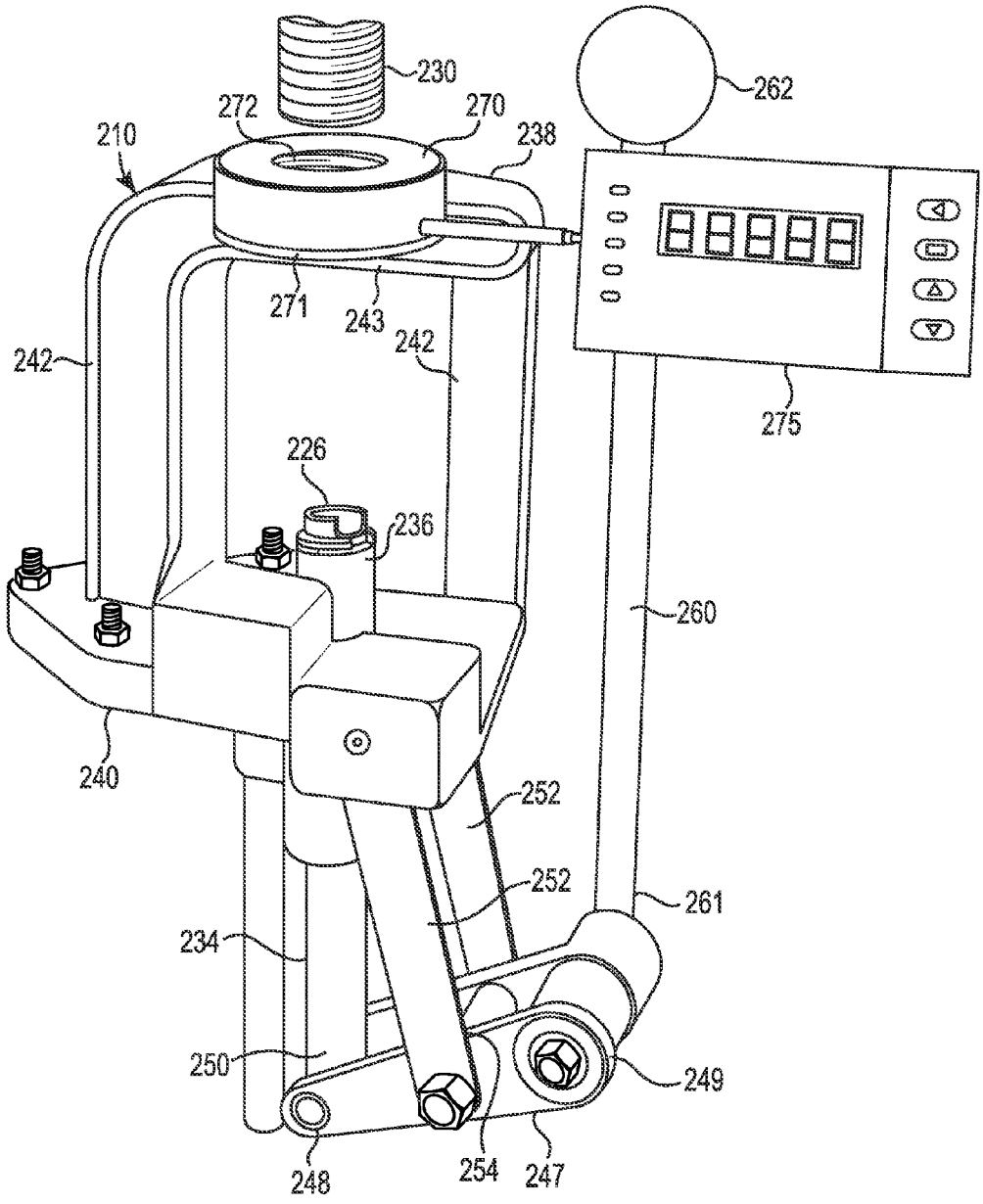
FIG. 9 is a view in perspective with a die separated to show detail of a third embodiment of a hand operated press for reloading rifle cartridges according to the present invention, which press includes indicating means comprising a load cell.
Figure 10:
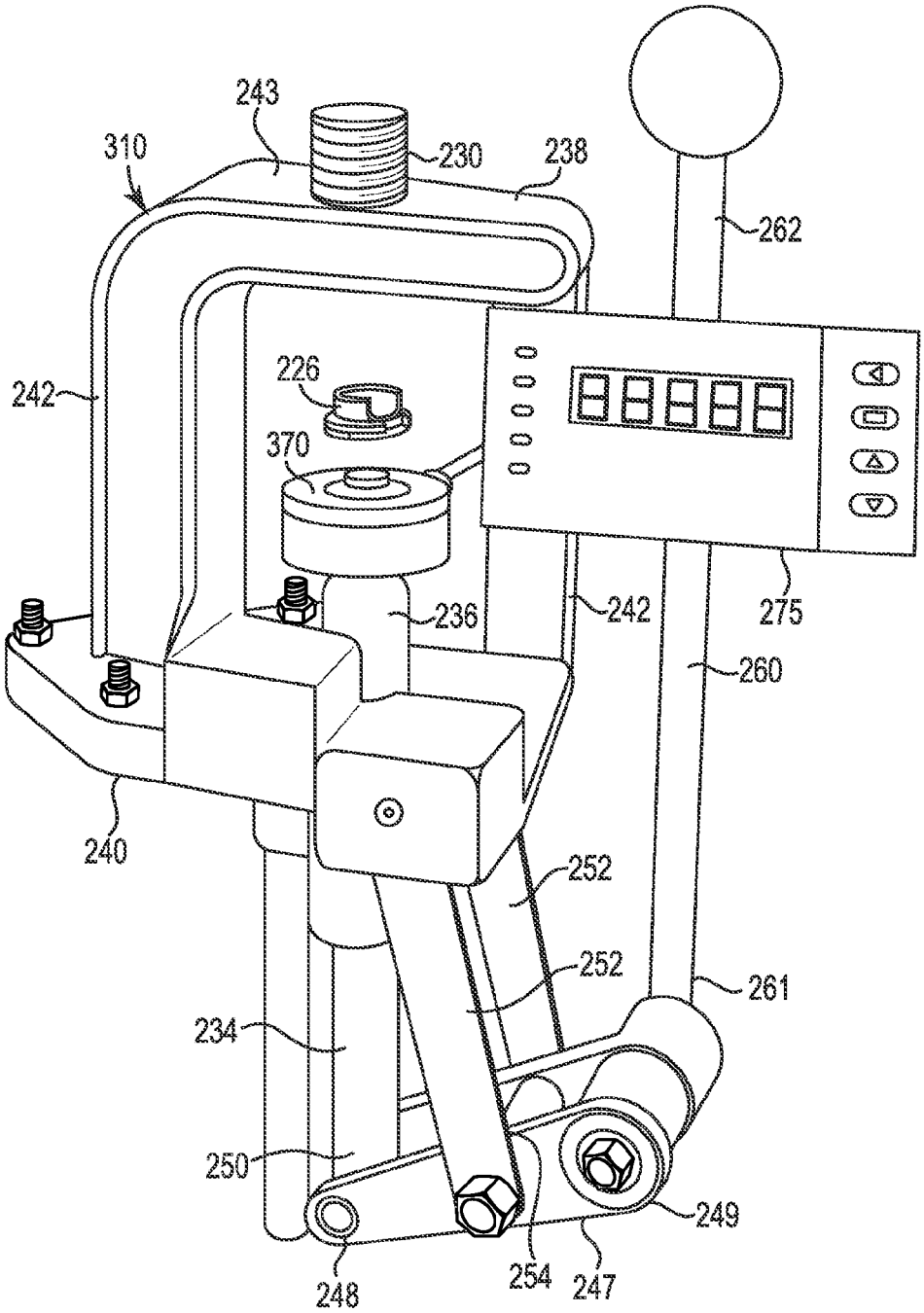
FIG. 10 is a view in perspective with some parts to show details of a fourth embodiment of a hand operated press for reloading rifle cartridges according to the present invention, which press includes indicating means comprising a load cell.

FIGS. 9 and 10 illustrate third and fourth embodiments of hand operated presses 210 and 310 according to the present invention, which presses 210 and 310 are modifications of a press for reloading rifle cartridges that is commercially available under the trade designation "Breech Lock Classic Cast" from Lee Precision, Inc., Hartford, Wis. (Information about that press in addition to that provided herein is provided in the owner's manual for the press and over the internet for Lee Precision, Inc., the content whereof is hereby incorporated herein by reference).

Like the presses 10 and 110 described above, the presses 210 and 310 are adapted for reloading elongate metal rifle cartridges 11 of the type illustrated in FIG. 2. The modifications to the commercially available press identified above to make the presses 210 and 310 include the addition to the presses 210 and 310 of indicating means for providing for an operator of the press 210 or 310 discrete indications relating to different forces that can be manually applied through the drive mechanism during use of the press 210 or 310 to crimp the second end 12 of a cartridge 11 against a bullet 32 in the cartridge 11 to allow the operator to use one of those indications to manually apply the same force to form essentially the same degree of crimp of the second ends 16 of identical cartridges 11 against identical bullets 32 in the cartridges 11. That added indicating means includes a load cell 270 on the press 210 and a load cell 370 on press 310 each mounted in a different position to be deformed different amounts by different forces manually applied through the drive mechanism on the press 210 or 310 to press the second end 16 of a cartridge against the forming surface of a die 230, and means in the form of a load reading device 275 connected to the load cell 270 or 370 for visually numerically indicating different amounts of deformation in the load cell 270 or 370 caused by those different amounts of applied force.

Generally, the presses 210 and 310 each include a cartridge receptacle 226 adapted to releasably receive and support the first end 12 of a cartridge 11 of a predetermined size and shape in the manner described above for the receptacles 26 and 126. Also, the presses 210 and 310 each include the die 230 that has an inner surface (not shown) defining a cavity adapted to receive the second end portion 17 of the cartridge 11 with a portion of a bullet 32 within its second end portion 17 and a portion of the bullet 32 projecting from the second end 16 of the cartridge 11. The inner surface of the die 230 includes a forming surface shaped to crimp the second end 17 of the cartridge 11 into firm engagement with the periphery of the bullet 32 when the cartridge 11 is pressed longitudinally into the die 230. The presses 210 and 230 also each include an elongate cylindrical cartridge receptacle support member 234 that releasably supports the cartridge receptacle 226 at its normally upper first end 236; together with a die support member 238 that supports the die 230, and means mounting the cartridge support and die support members 234 and 238 for affording their relative movement between a first relative position illustrated in FIGS. 7 and 8 with the cartridge receptacle 226 sufficiently spaced from the die 230 to afford manually portioning the cartridge 11 on or removal of the cartridge 11 from the cartridge receptacle 226, and a second position (not shown) with the second end portion 17 of the cartridge 11 supported on the cartridge receptacle 226 within the die 230 with the second end 16 of the cartridge pressed against the forming surface in the die 230. That die support member 238 is a generally "D" shaped casting that includes a base portion 240 adapted to have its bottom surface supported on a wooden support to which it is bolted, opposite spaced portions 242 projecting from an upper surface of the base plate 140, and an upper portion 243 at the ends of the spaced portions 242 opposite the base portion 240, which upper portion 243 has a through passageway in which the die 230 is positioned. The means mounting the cartridge support and die support members 234 and 238 for relative movement between their first and second relative positions described above includes a surface defining a bore through the base portion 240 of the die support member 238 in which bore the elongate cylindrical cartridge support member 234 is closely received for longitudinal sliding movement with its upper first end 236 that releasably supports the cartridge receptacle 226 adjacent the upper portion 243 and axially aligned with the die 230 on the upper portion 243.

The drive mechanism mentioned above can be manually operated to move the cartridge receptacle support and die support members 234 and 238 between their first and second relative positions and to manually apply different forces between the second end 16 of a cartridge 11 on the cartridge receptacle 226 and the forming surface in the die 230 to crimp the second end 16 of the cartridge 11 into engagement with the periphery of the bullet 32 in the cartridge 11. That manually operable drive mechanism comprises a first elongate bar 247 having a first end 248 pivotably attached to a second end 250 of the cartridge receptacle support member opposite its upper first end 236; and two elongate second bars 252 having first ends pivotably attached in spaced relationship to the base portion 240 of the die support member 238, and second ends 254 pivotably attached to the first elongate bar 247 adjacent its second end 254 opposite its first end.

The manually activate able drive mechanisms of the presses 210 and 310 further include a drive lever 260 having one end portion 261 engaged with and fixed to the first elongate bar 247 at its second end 249, and an opposite manually engage able end portion 262 terminating in a ball that can be used to rotate the lever 260 and first elongate bar 247 to which it is fixed, and thereby move the cartridge receptacle support member 234 toward the die 230 to move the cartridge receptacle support and die support members 134 and 138 from their first to their second relative positions.

The load cell 270 on the press 210 (FIG. 9) is annular, has a base 271 attached to the die support member 238, and has an internal threaded surface 272 defining a through opening with which internal surface the die 230 is threadably engaged. The opening through the load cell 270 is aligned with the opening for the die through the die support member 238 and is made sufficiently large to afford axial movement of the die 230 therein. When the drive mechanism is manually operated to press the second end 16 of a cartridge 11 on the cartridge receptacle 226 into engagement with the forming surface in the die 130 to crimp the second end 16 of the cartridge 11 into engagement with the periphery of the bullet 32 in the cartridge 11, a series of numbers corresponding to amounts of load in tension between the base of the cartridge and its internal surface engaged with the die 230 will be visually displayed on the load reading device 275 connected to that load cell 270 to indicate the different amounts of load in the load cell 270 caused by the different pressures between the second end 16 of the cartridge 11 and that forming surface, thereby providing the indicating means.

The load cell 270 can be or be similar to the zero to 500 pound force load cell designated "Bolt through Load Cell" that is commercially available from Monad Electronics, India, and the load reading device 275 can be the a load reading device that is also commercially available from Monad Electronics, India that displays real time force, saves its maximum force measurement, and has an alarm that can be set for a predetermined force.

The load cell 370 on the press 310 (FIG. 10) is circular, has a base attached to the first end 236 of the cartridge receptacle support members 234, and supports the cartridge receptacle 226 on its surface opposite the cartridge receptacle support member 234. When the drive mechanism is manually operated to press the second end 16 of a cartridge 11 on the cartridge receptacle 226 into engagement with the forming surface in the die 230 to crimp the second end 16 of the cartridge 11 into engagement with the periphery of the bullet 32 in the cartridge 11, a series of numbers corresponding to the amounts of load in compression in the load cell 370 will be visually displayed on the load reading device 275 connected to that load cell 270 to indicate the amounts of deformation in the load cell 370 caused by the different pressures between the second end 16 of the cartridge 11 and that forming surface, thereby providing the indicating means.

The load cell 370 can be or be similar to the load cell designated "Button Load Cell, Model MT-09" that is commercially available from Monad Electronics, India, and the load reading device 275 can be the same as the load reading device 275 described above.

Figure 11:
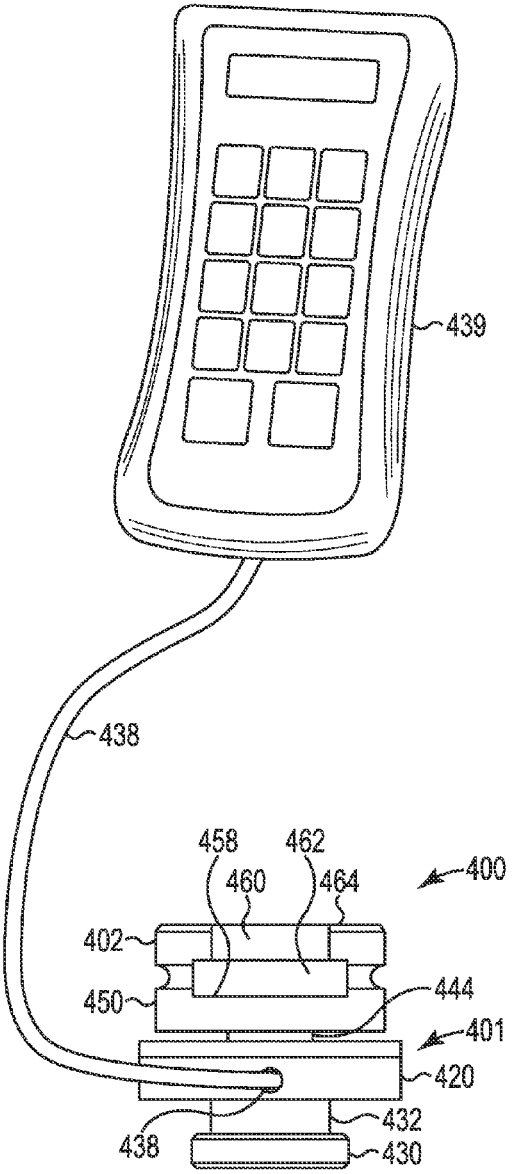
FIG. 11 is a side view of a load cell assembly according to the present invention.
Figure 12:
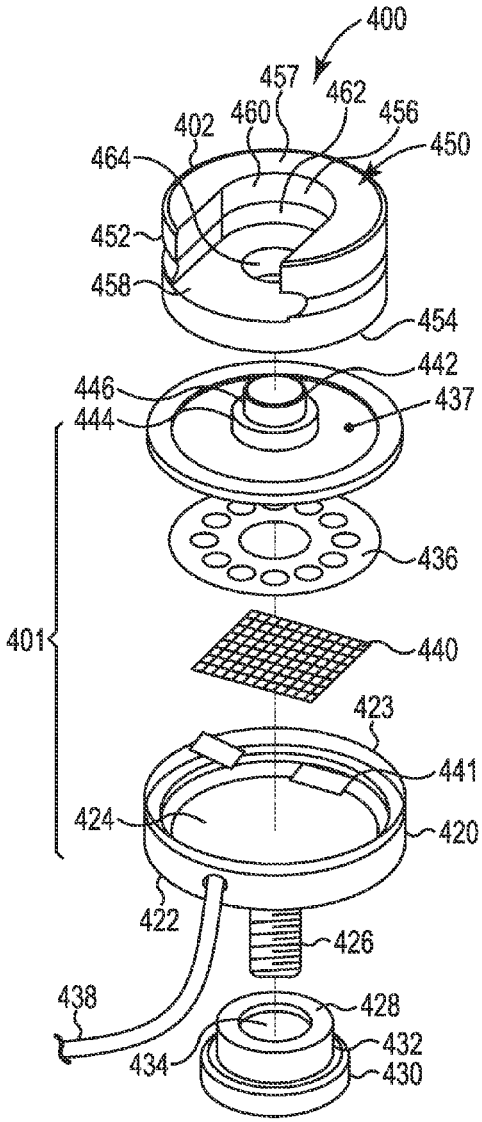
FIG. 12 is an exploded view in perspective of the load cell assembly illustrated in FIG. 11.
Figure 13:
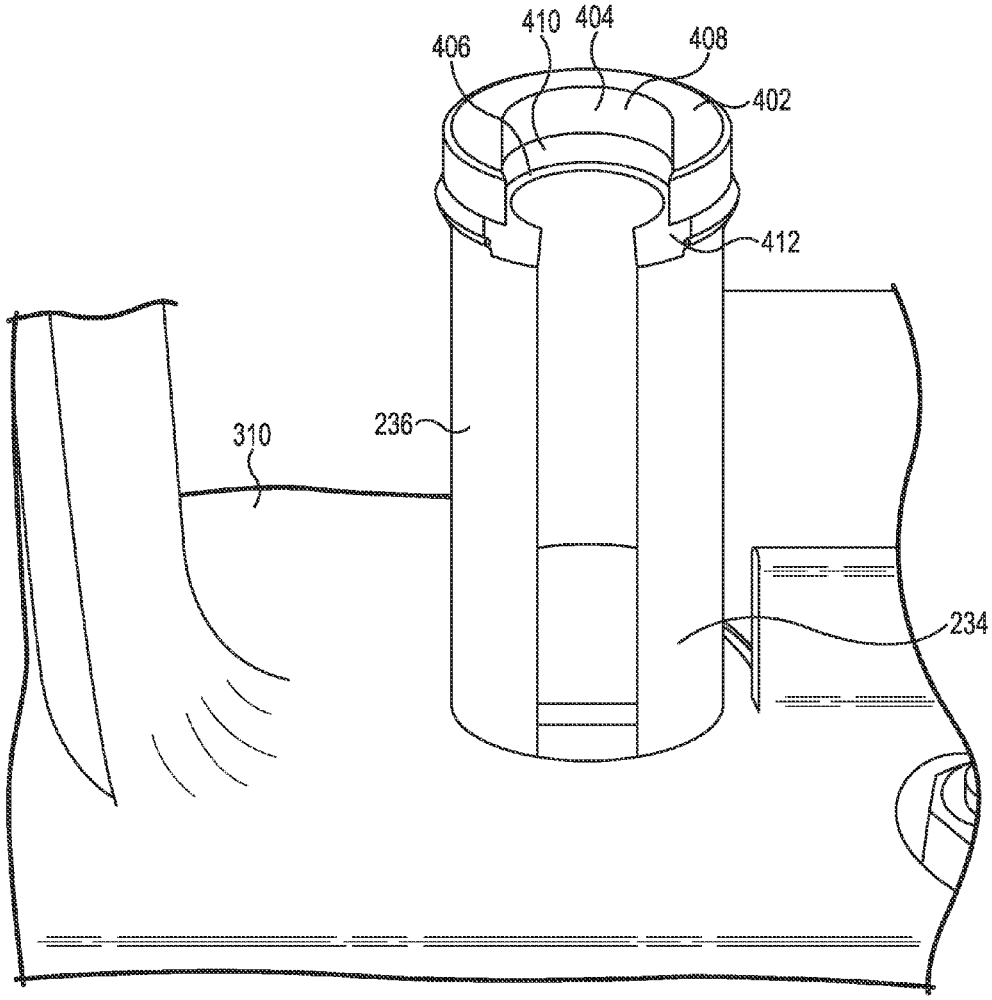
FIG. 13 is a fragmentary perspective view showing an upper end portion of a cartridge receptacle support member included in a single stage reloading press.

Referring now to FIGS. 11 and 12 there is illustrated a load cell assembly 400 according to the present invention that includes a load cell 401 and a second part of attachment means on the load cell 401 adapted to releasably engage with, attach to and support the load cell 401 on the first end 236 of the cartridge receptacle support member 234 of a commercially available press generally of the type 310 illustrated in FIGS. 10 and 13 (e. g. a Lee Classic Cast Press or a Lee Classic Cast Turret Press, both commercially available from Lee Precision, Inc. Hartford, Wis.).

Figure 14:
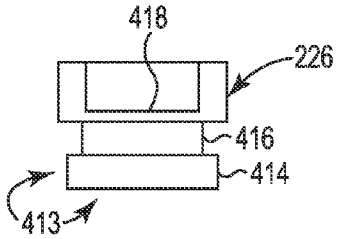
FIG. 14 is a side view of a cartridge receptacle for use on the cartridge receptacle support member illustrated in FIG. 13.

The load cell assembly 400 also includes a first part of attachment means on the load cell 401 adapted to releasably engage, attach to, and support a cartridge receptacle 226 (see FIG. 14) on an end 402 of the load cell 401 is opposite the first end 236 of a cartridge receptacle support member 234 with which the load cell 401 engaged, attached to, and supported with the cartridge receptacle 226 in axial alignment with the cartridge receptacle support member 234.

As is illustrated in FIG. 13 and as is well known by users of presses generally of the type 310, the first end 236 of the cartridge receptacle support member 234 has a first part of attachment means comprising surfaces defining a generally U-shaped channel 404 opening through an end surface 402 and one side of the cartridge receptacle support member 234. The surfaces defining the U-shaped channel 404 include (1) a base surface 406 at a right angle to the axis of the receptacle support member 234 at the bottom of the U-shaped channel 404, (2) a first or upper U-shaped surface 408 parallel to the axis of the receptacle support member 234 having an inner semi-cylindrical portion concentric with that axis, and (3) a second or lower U-shaped surface 410 parallel to the axis of the receptacle support member 234 between the first U-shaped surface 408 and the base surface 406 that is larger than the first U-shaped surface 408 to provide a U-shaped recess 412 between the base surface 406 and the part of the receptacle support member 234 having the first U-shaped surface 408.

The cartridge receptacle 226 (see FIG. 14) has a second part of the attachment means on a first end portion 413 of the cartridge receptacle 226 comprising a disk like part 414 at its first end adapted to be closely received in the recess 412, and a coaxial circular connecting part 416 having a diameter smaller than the diameter of the disk like part 414 adapted to be closely received by the upper U-shaped surface 408. When the load cell assembly 400 is not attached to the press 310, the cartridge receptacle 226 can be releasably engaged with, attached to and supported by the cartridge receptacle support member 234 by moving the cartridge receptacle 226 transverse of the support member 234 so that the disk like part 414 moves into and along the recess 412 while the connecting part 416 moves into the part of the channel 404 defined by the first U-shaped surface 408 to a position with the disk like part 414 and the connecting part 46 in contact respectively with the inner ends of the U-shaped surfaces 410 and 408. At that position the center of a recessed circular cartridge support surface 418 on the cartridge receptacle 226 above the disk like part 414 is aligned with the axis of the cartridge receptacle support member 234 and the disk like part 414. Cartridge receptacles 226 are commercially available with cartridge support surfaces 418 sized to support the rear surfaces of many sizes of cartridges, (e.g., 0.308, 30-06, 25-20, 45-70, etc.) so by using the appropriately sized cartridge receptacle 226, the press 310 can be used to reload cartridges of many different sizes.

The load cell 401 of the load cell assembly 400 includes a tubular or cylindrical steel wall 420 having an axis and first and second axially spaced ends 422 and 423, and a first stiff steel end wall 424 (e.g., 7 millimeters in thick) attached to and closing the first end 422 of the cylindrical wall 420. One end of a steel threaded stud 426 is co-axially attached as by welding to the side of the first end wall 424 opposite second end 423 of the cylindrical wall 420. The load cell assembly 400 includes a second part of attachment means comprising an attachment member 428 having a disk like part 430 at one end adapted to be closely received in the recess 412 of the channel 404 on the cartridge receptacle support member 234, and a coaxial circular connecting part 432 having a diameter smaller than the diameter of the disk like part 430 adapted to be closely received by the first U-shaped surface 408 of the channel 404. The attachment member 428 has a coaxial internally threaded opening 434 threadably engaging the stud 426 with the connecting part 432 adjacent the first end wall 424.

The load cell 401 includes a flexible force transducer disk or wall 436 attached to the second end 423 of the cylindrical wall 420. The load cell 401 further includes a strain gauge 436 (e.g., a full bridge strain gauge) attached to the second end 423 of the cylindrical wall 420 and a modulus gauge 441. The strain gauge 436 is mounted against the surface of the force transducer disk 437 adjacent the first end wall 424. The modulus gauge 441 is positioned adjacent the first end wall 424 and serves to allow the electrical signal values given by the stain gauge 436 to be unaffected by temperature. Wires 438 connected to the strain gauge 436, the modulus gauge 441 and a flex circuit sheet 440 extend through an opening in the cylindrical wall 420 and are connected to a load reading device 439 (see FIG. 11). The flex circuit sheet 440 is positioned between the strain gauge 436 and the first end wall 424, where the wires 438 are operatively coupled to the strain gauge 436 and the flex circuit sheet 440 to allow changes in an electrical signal to be sensed from the load cell assembly 400. An example of a load cell assembly 400 includes those available from Futek Advanced Sensor Technology or Interface, Inc. Specific examples include, but are not limited to, models LLB 130 from Futek or LBS miniature compression load buttons from Interface, Inc.

On the side of the circular force transducer disk 437 opposite the first end wall 424 is a coaxial support member 442 including a disk like base portion 444 and a cylindrical projection 446. The cylindrical projection 446 can have a threaded outer surface. The load cell assembly 400 includes a first part of attachment means comprising a generally cylindrical cartridge receptacle support member 450 that has a threaded cylindrical coaxial bore 452 from a first end 454 sized to receive and engage via the threaded surfaces the projection 446 so that the first end 454 of the cartridge receptacle support member 450 rests against the base portion 444 of the support member 442. The base portion 444 spaces the cartridge receptacle support member 450 from the surface of the circular force transducer disk 437 to allow it to freely flex and activate the strain gauge 436 when force is applied to compress the load cell 401. The cartridge receptacle support member 450 has surfaces defining a generally U-shaped channel 456 opening through a second end 457 and one side of the cartridge receptacle support member. Those surfaces include a base surface 458 at a right angle to the axis of the receptacle support member 450 at the bottom of the U-shaped channel 456, a first or upper U shaped surface 460 parallel to the axis of the receptacle support member 450, a second or lower U shaped surface 462 parallel to the axis of the receptacle support member 450 between the first U-shaped surface 460 and the base surface 458 that is larger than the first U-shaped surface 460 to provide a U-shaped recess 464 between the base surface 458 and the part of the receptacle support member having the first U-shaped surface 460. These surfaces correspond in size and shape to the corresponding surfaces of the cartridge receptacle support member 234 that define the channel 404. Thus the cartridge receptacle 226 can be engaged with, attached to, and supported by the cartridge receptacle support member 450 of the load cell assembly 400 by moving the cartridge receptacle 226 transverse of the support member 450 so that the disk like part 414 moves into and along the recess 464 to a position contacting the end of the second U-shaped surface 462 while the connecting part 416 moves into the part of the channel 456 defined by the first U-shaped surface 460. At that position the center of a recessed circular cartridge support surface 418 on the cartridge receptacle 226 above the disk like part 414 is aligned with the axis of the first end portion 236 and the disk like part 414.

When the load cell assembly 400 is engaged with, attached to, and supported on the first end 236 of the cartridge receptacle support member 234 of the press 310, a cartridge receptacle 226 can be engaged with, attached to, and supported on the cartridge receptacle support member 450 of the load cell assembly 400. When a cartridge on that cartridge receptacle 226 is then pressed into a die on the press by manual operation of the press 310 different electrical signals through the wires 438 to the load reading device 439 caused by deflections of the flexible wall 437 and strain gauge 436 by forces applied through the load cell will cause visual indications on the reading device of the different forces that are being manually applied by use of the press 310 to press the cartridge into the die.

The load cell 401 is a transducer that is used to convert a force applied through the use of the press 310 into an electrical signal. The strain gauge 436 deflects under an applied force, where the deformation (strain) is measured as an electrical signal. This strain changes the effective electrical resistance of the strain gauge 436 (e.g., wires within the strain gauge). The load cell 401 can consist of four strain gauges in a Wheatstone bridge configuration. The load cell 401 can also be configured with one strain gauge (quarter bridge) or two strain gauges (half bridge) as desired. The electrical signal output is typically in the order of a few millivolts and requires amplification by the load reading device 439. The output of the load cell 401 can be scaled to calculate the force applied to the transducer.

The load reading device 439 includes an input socket through which the electrical signal output from the strain gauge 436 of the load cell assembly 400 can be received. Electrical inputs can range up to 5 Volts and as low as about 19 millivolts with a 2.5 volt reference, and sampling of such electrical inputs can be from 5 to 4800 samples per second. For example, the processor of the load reading device 439 can be clocking at 16 mhz, with samples being read 39 times a second (39 Hz) (e.g., up to 470 Hz) with a settle time of 48 milliseconds. Other electrical input values and sampling rates are also possible. The load reading device 439 can include a power source (e.g., a battery), a LCD six digit display (e.g., a 16×4 character LCD) with plus sign and decimal point, brightness/contrast adjustment, a keypad input that can be used to, among other things, turn the load reading device 439 on and off, navigate operations menus and functions such as peak/valley values, tare/gross values, battery level, input alarm settings and track/hold values, among others. Examples of such a load reading device 439 include those from Futek Advanced Sensor Technology or Transducer digital indicator Model 9320 from Interface, Inc. Other load reading devices are possible.

In addition to visually indicating the different forces that can be manually applied by use of the press to press the cartridge into the die, the load reading device 439 can be adapted to provide indications of the force applied on a previous use of a press device to facilitate applying the same force on subsequent uses of the press, and can also capture maximum pressure used in a cycle, maximum pressure ever applied to the strain gauge, a clear button to clear stored pressure values, an audible and/or visual alarm to notify user when target value has been attained, an audible and/or visual alarm to indicate when an over load pressure value is near, a low battery indicator and a volume adjustment for the audible alarms.

Preferably the load cell assembly 400 should be calibrated to provide indications of forces generally in the range of zero (0) to 500 pound-force. Other value ranges are possible (e.g., zero (0) to 50 pound-force).

Preferably the load cell assembly 400 should have a relatively short axial length from the first end 422 of the cylindrical wall 420 to the opposite surface of the base portion 444 of the support member 442 (e.g., 6.5 millimeters) to minimize the loss of space between the cartridge receptacle 226 and the die when the load cell assembly 400 is used on the cartridge receptacle support member 234 of the press 310.

The second part of the attachment means including the attachment member 428 could be adapted to be attached to the outer surface of the flexible wall 437 instead of to the first end wall 424, and the first part of the attachment means comprising the cartridge receptacle support member 450 could be adapted to be attached to the outer surface of the first end wall 424 which would invert the load cell 401 when in use on the press 310 should that be desired. Also, the first and second parts of the attachment means on the load cell 401 could be adapted to engage attachment means having a second part on the first end portion of a cartridge receptacle and a first part on a first end portion of a cartridge support member for releasably engaging and supporting the cartridge receptacle on the cartridge support member which parts differ in structure from those described above.

The load cell assembly 400 will be useful to provide for an operator of a press discrete indications of the different forces that can be manually applied through the drive mechanism of the press during use of the press to crimp the second end of a cartridge against a bullet in a cartridge to allow the operator to use one of said indications to manually apply the same force to form essentially the same degree of crimp of the second ends of identical cartridges against identical bullets in the cartridges. Additionally, the load cell assembly 400 may also be useful to allow the operator to use one of said indications to manually apply the same force to press a cartridge into any die, such as a neck sizing die (a die that reduces the diameter of the neck to attain various "neck tension") which the user may test for optimal downrange performance. The load cell assembly 400 may also be useful with an Arbor style press in which a die presses a bullet into the neck of a cartridge in an interference fit so as to provide greater consistency with the results of those operations.

Several aspects of the present invention have now been described, including, but not limited to, four embodiments of presses for loading rifle cartridges including indicating meant of the types described above, and a novel adapter kit useful to modify one of those presses to include the indicating means. It will be apparent to those skilled in the art that many changes can be made in the embodiments and structures described without departing from the scope of the present invention. Thus, the scope of the present invention should not be limited to the embodiments and structures described in this application, but only by the embodiments and structures described by the language of the claims and the equivalents thereof.

What is claimed is:

1. A load cell assembly adapted for use with a hand operated press for manipulating metal rifle cartridges of the type each having a first end adapted to receive a primer, a second opposite end, and a generally cylindrical end portion adjacent said second end, said press comprising:

a cartridge receptacle having a first end portion and an opposite second end portion adapted to releasably receive and support the first end of a cartridge of a predetermined size and shape;

a cartridge support member having a first end portion;

attachment means having a second part on the first end portion of the cartridge receptacle and a first part on the first end portion of the cartridge support member for releasably engaging and supporting the cartridge receptacle on the cartridge support member;

a die having an inner surface defining a cavity adapted to receive and engage the second end portion of the cartridge;

a die support member supporting the die;

means mounting the cartridge support and die support members for relative movement between a first relative position with the cartridge receptacle sufficiently spaced from the die to afford manually positioning a cartridge on or removal of a cartridge from the cartridge receptacle, and a second relative position with the second end portion of a cartridge supported on the cartridge receptacle engaged within the die;

a manually operable drive mechanism for moving said cartridge support and die support members between said first and second relative positions and for manually applying different forces between the second end of a cartridge on said cartridge receptacle and said die;

said load cell assembly comprising:

a load cell including a hollow tubular wall having an axis and first and second axially spaced ends;

an first end wall closing the first end of said tubular wall and having an outer surface on the side of said end wall opposite said second end of said tubular wall;

a flexible end wall closing the second end of said tubular wall, said flexible end wall having an inner surface adjacent said first end wall and an opposite outer surface;

a strain gauge within said tubular wall along the inner surface of said flexible end wall;

a first part of attachment means on the outer surface of one of said end walls having essentially the same shape as the first part of the attachment means on the first end portion of the cartridge support member; and a second part of said attachment means on the outer surface of the other of said end walls having essentially the same shape as the second part of the attachment means on the first end portion of the cartridge receptacle;

said second part of the attachment means on the outer surface of one of said end walls being adapted to engage and be supported by the first part of the attachment means on the cartridge support member of the press and said first part of the attachment means on the outer surface of the other of said end walls being adapted to engage and support the second part of the attachment means on the cartridge receptacle; and said load cell assembly further including indicating means including a load reading device connected to said strain gauge for, when load cell is attached between said cartridge support member and said cartridge receptacle of the press, providing for an operator of the press discrete indications of the different forces that can be manually applied through the drive mechanism during use of the press to engage the second end of a cartridge against the die to allow the operator to use one of said indications to manually apply the same force to engage the second ends of identical cartridges with the die.

2. A load cell assembly according to claim 1 wherein said first part of said attachment means on the outer surface of one of said end walls is on the outer surface of said flexible end wall, and said second part of said attachment means on the outer surface of the other of said end walls is on the outer surface said first end wall.

3. A load cell assembly according to claim 1 wherein said first part of said attachment means on the outer surface of one of said end walls comprises a cartridge receptacle support member having surfaces defining a generally U-shaped channel opening through a second end and one side of the cartridge receptacle support member, said surfaces including a base surface at a right angle to the axis of the receptacle support member at the bottom of the U-shaped channel, a first or upper U shaped surface parallel to the axis of the cartridge receptacle support member, a second or lower U shaped surface parallel to the axis of the receptacle support member between the first U-shaped surface and the base surface that is larger than the first U-shaped surface to provide a U-shaped recess between the base surface and the part of the receptacle support member having the first U-shaped surface, and said second part of said attachment means on the outer surface of the other of said end walls comprises an attachment member having a disk like part at one end, and a coaxial circular connecting part having a diameter smaller than the diameter of the disk like part between the disk like part and the wall of the load cell.

4. A hand operated press for manipulating metal rifle cartridges of the type each having a first end adapted to receive a primer, a second opposite end, and a generally cylindrical end portion adjacent said second end, said press comprising:

a cartridge receptacle adapted to releasably receive and support the first end of a cartridge of a predetermined size and shape;

a die having an inner surface defining a cavity adapted to receive and engage the second end portion of the cartridge;

a cartridge support member supporting said cartridge receptacle;

a die support member supporting said die;

means mounting said cartridge support and die support members for relative movement between a first relative position with the cartridge receptacle sufficiently spaced from the die to afford manually portioning said cartridge on or removal of said cartridge from the cartridge receptacle, and a second relative position with the second end portion of said cartridge supported on the cartridge receptacle engaged within the die;

a manually operable drive mechanism for moving said cartridge support and die support members between said first and second relative positions and for manually applying different forces between the second end of a cartridge on said cartridge receptacle and said die;

indicating means for providing for an operator of the press discrete indications of the different forces that can be manually applied through the drive mechanism during use of the press to engage the second end of a cartridge against the die to allow the operator to use one of said indications to manually apply the same force to engage the second ends of identical cartridges with the die.

5. A hand operated press according to claim 1 wherein said indicating means comprises a load cell mounted between said cartridge receptacle support member and said cartridge receptacle in a position to be deformed by a force applied by said drive mechanism to press the second end of the cartridge against the forming surface of the die, and means connected to said load cell for visually indicating the different amounts of load in the load cell caused by said different forces.

* * * * *